United States Patent [19]

Rösler

[11] Patent Number: 4,509,656

[45] Date of Patent: Apr. 9, 1985

[54] VARIABLE LENGTH PACKING CONTAINER ASSEMBLY

[75] Inventor: Peter Rösler, Wangen, Fed. Rep. of Germany

[73] Assignee: Rose-Plastic GmbH, Hergensweiler, Fed. Rep. of Germany

[21] Appl. No.: 534,084

[22] Filed: Sep. 20, 1983

[30] Foreign Application Priority Data

Sep. 24, 1982 [DE] Fed. Rep. of Germany ... 8226875[U]

[51] Int. Cl.[3] ..... B65D 11/02; B65D 85/54

[52] U.S. Cl. ..... 220/8

[58] Field of Search ..... 220/8

[56] References Cited

U.S. PATENT DOCUMENTS

| | | | |
|---|---|---|---|
| 1,450,674 | 4/1923 | Marston | 220/8 |
| 1,872,771 | 8/1932 | Little | 220/94 A |
| 1,934,138 | 11/1933 | Paul | 220/8 |
| 2,256,257 | 9/1941 | Dukehart | 220/8 |
| 3,494,499 | 2/1970 | Plog | 220/8 |
| 3,521,810 | 7/1970 | Boyer | 220/8 |
| 3,851,792 | 12/1974 | Ankney | 220/8 |
| 4,046,279 | 9/1977 | Rosler | 220/8 |
| 4,210,253 | 7/1980 | Rosler | 220/8 |

FOREIGN PATENT DOCUMENTS

| | | | |
|---|---|---|---|
| 2431672 | 1/1976 | Fed. Rep. of Germany | 220/8 |

*Primary Examiner*—George E. Lowrance

*Attorney, Agent, or Firm*—Toren, McGeady and Stanger

[57] ABSTRACT

A packing container assembly particularly for storing elongated objects is formed with inner and outer elongated interfitting hollow members each having a polygonal cross-sectional configuration with a closed end and an open end longitudinally slidable relative to each other. Each of the hollow members is formed with interlocking members which cooperate to fix the hollow members in engagement with each other. The interlocking members on the outer hollow member are inwardly projecting webs located adjacent the open end of the outer hollow member at corners thereof and the interlocking members of the inner hollow member are outwardly projecting elevations spaced apart in the longitudinal direction thereof with elevations being provided at at least two diagonally opposite corners of the inner hollow member lying in a common plane extending perpendicularly to the longitudinal direction thereof. The hollow members are formed with rounded corners having specific radii which differ from each other.

13 Claims, 8 Drawing Figures

VARIABLE LENGTH PACKING CONTAINER ASSEMBLY

The present invention relates generally to a packing container especially suited for storing elongated objects. More specifically, the invention relates to a packing container formed of a pair of hollow members having closed outer ends which are interfitted one within the other and which are adapted for sliding relative movement therebetween along the longitudinal lengths thereof.

The container to which the present invention relates is formed on the outer surface of the inner hollow member in a direction parallel to its longitudinal axis and extending in a row over the largest portion of the length thereof with elevations which are arranged to project beyond the outer surface. The elevations cooperate with a counter member which is formed in the area of the open end of the outer hollow member by a recess and which interacts with the elevations in the manner of interlocking teeth.

When objects of different lengths must be packed into a container in such a manner that they are essentially held immovably therein in the longitudinal direction of the container, it becomes necessary to provide for each of these objects a container which will generally correspond to the length of the object to be packaged. This gives rise to the need for providing a plurality of packing containers so that a plurality of objects of different lengths may be conveniently packaged. Such a necessity causes the costs for the packaging itself to be increased, since there develops an increased need for molds or tools required in the manufacturing of the container, but there also occurs an increase in the costs for storage since an increased supply of the containers must always be available.

In some instances, additional difficulties arise in that objects with increasing length also have larger circumferential or cross-sectional dimensions. An additional and important aspect which must be considered in this context resides in the fact that the packing processes must be automated as much as possible and thus the packing container must be compatible with this need.

A packing container known in the prior art, from German Utility Model No. 76 20 793, is formed with a circular cross-section and consists of two hollow bodies which are closed at end faces thereof and which can be connected together by relative sliding movement in the longitudinal direction thereof. At one of the hollow bodies, there are provided locking teeth which extend essentially over the entire length thereof, and at the other hollow body, in the area of its open end, a counter member is provided which interacts with the locking teeth of the one hollow body. The locking teeth at the outer surface of the inner hollow body have outwardly directed teeth and the counter member which interacts with the teeth has an annular indentation which encircles the outer hollow body adjacent to its open end.

This packing container, while generally satisfactory, can only be used for objects having circular or approximately circular cross-sectional configurations. For objects having square cross-sectional configurations, it has proven disadvantageous since only a square configuration which can be encircled by the circular form of the packing container can be utilized. These disadvantages are accentuated in objects having rectangular cross-sectional configurations.

In view of the foregoing state of the art, the present invention is directed toward provision of a packing container formed of two parts particularly adapted for elongated objects which provides the possibility to store therein objects of different lengths and in specific areas of different angular cross-section, particularly in an automatically operating packing process. In order to adapt the packing container of the invention to different dimensions, merely the length and the cross-section of the two parts which form the packing container are changed, the basic construction and usefulness in automatic packing machines being maintained. Additionally, the packing container is provided with locking teeth which are more effective than those known in the art and which are simpler to manufacture, and the range of use of the packing container is expanded.

SUMMARY OF THE INVENTION

Briefly, the present invention may be described as a packing container assembly particularly for storing elongated objects comprising: an inner and an outer elongated hollow member each having a polygonal cross-sectional configuration with a closed end and an open end, said open end of said inner hollow member being inserted into said open end of said outer hollow member to place said hollow members in longitudinal sliding engagement with each other to form said container assembly; first interlocking means formed on the outer surface of said inner hollow member; second interlocking means formed on the inner surface of said outer hollow member; said first and said second interlocking means cooperating to hold said hollow members in fixed engagement with each other; at least one of said first and second interlocking means comprising a plurality of longitudinally spaced members with at least two of said longitudinally spaced members being located diagonally opposite each other and lying in a common plane extending perpendicularly to the longitudinal direction of said hollow members; the polygonal cross-sectional configuration of each of said hollow members being formed with interfitting corners with the corners of said inner hollow member being formed with a radius of curvature which is greater than the radius of curvature of said corners of said outer hollow member.

Thus, in accordance with the present invention, an improvement is achieved in that there is provided a packing container wherein two hollow members having an angular or polygonal cross-sectional configuration with rounded edges are provided with at least two diagonally opposite corners of the inner hollow member being provided with interlocking means in the form of elevations constructed in a spaced-apart arrangement and located generally in common planes perpendicular to the longitudinal axis of the hollow members. At each corner of the outer hollow member adjacent its open end, an inwardly projecting web is arranged between two adjoining walls with the outer radius of curvature of the corners of the inner hollow member being larger than the inner radius of curvature of the corners of the outer hollow member.

Due to the angular or polygonal cross-section of the packing container, which may be square as well as rectangular, it is possible to pack elongated objects of square cross-section having a length which may vary within the given cross-section within a wide range, i.e., up to approximately the entire length of the two extended hollow members. However, it is also possible, particularly with a container having a square cross-sectional configuration, to package objects having a circular cross-sectional configuration and, particularly in a container with a rectangular cross-sectional configuration, objects having an oval cross-sectional configuration may be conveniently packed.

Furthermore, with the present invention, a packing container having a wide range of use may be provided which can be utilized in automatic packing equipment and processes and which may be manufactured in a relatively simple and economical manner. Plastic is the preferred material with which the packing container is formed, and the container may be transparent or it may be formed of colored material. Manufacturing of the container may be accomplished preferably in accordance with a blowing procedure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
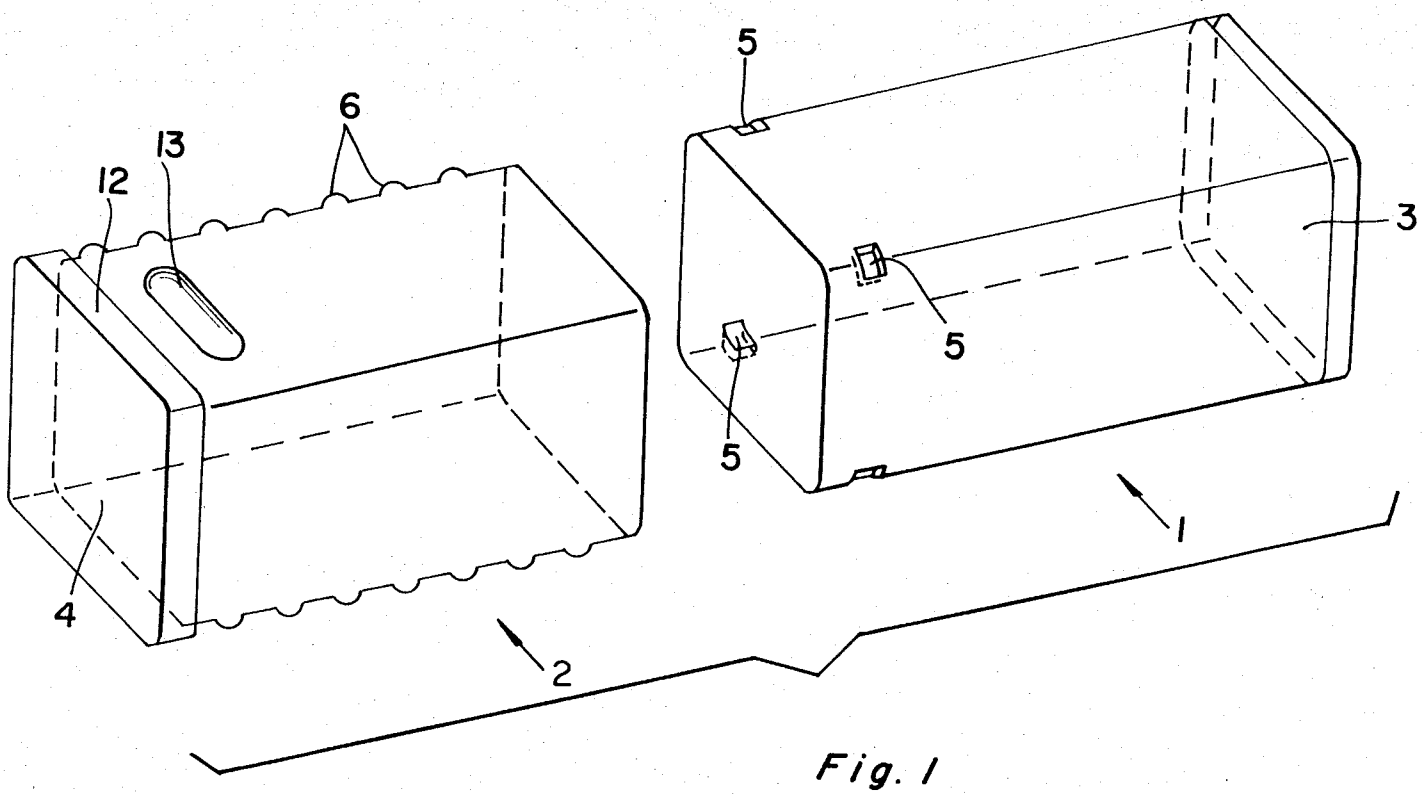
FIG. 1 is a perspective exploded view showing the two hollow members of the packing assembly separated, the hollow members being adapted to be combined by a sliding relative movement along the longitudinal direction thereof to form the packing container assembly of the invention so as to be closed on all sides.

Referring now to the drawings, various embodiments of the packaging container assembly in accordance with the invention are described as having a square cross-sectional configuration, but it is to be understood that the invention is not to be limited in this respect since rectangular cross-sectional configurations for the packaging containers constructed basically in the same manner are also contemplated.

With reference to FIG. 1, there is shown a packing container assembly which is formed to consist of two hollow bodies including an outer hollow body 1 and an inner hollow body 2 which may be connected together by sliding relative motion therebetween along their longitudinal axes. The end faces of the two hollow bodies or members 1 and 2 which face toward one another are open, and the opposite end faces of the hollow members 1 and 2 are closed, with the outer hollow member 1 having a closed end face 3 and with the inner hollow member 2 having a closed end face 4. The hollow members 1 and 2 are dimensioned with regard to their cross-sectional configuration in such a manner that the associated longitudinal walls are in generally close contact.

The hollow members 1 and 2 are assembled by placing the open end of the inner hollow body 2 within the open end of the outer hollow body 1 and in the assembled state, the overall or total length of the packing container assembly is variable within a wide range. That is, the overall length of the container assembly may be varied between a length approximately equivalent to the length of one of the hollow members up to approximately the combined length of both hollow members taken together, the hollow members being locked relative to one another to form the finished assembly.

For the purpose of fixing or interlocking the members 1 and 2 relative to each other, the outer hollow member 1 is formed with corners which are rounded off and which have at each of these corners adjacent to the open end of the member 1 a web 5 which extends between two of the side walls which adjoin each other at one of the corners. The webs 5 extend transversely to the longitudinal direction or axis of the hollow member 1.

The inner hollow member 2 is provided at its corners, which are also rounded, with elevations 6 which project beyond the outer surfaces thereof, and the webs 5 and the elevations 6 form first and second interlocking means which interact or interlock with each other in the manner of locking teeth to fix the relative positions of the members 1 and 2.

Although in the embodiment shown in FIG. 1, the webs 5 are provided at all four corners of the outer hollow body 1, it may be sufficient in a smaller packing container or in a packing container having a square cross-sectional configuration to provide the elevations 6 only at diagonally opposite corners of the inner hollow body or member 2. In larger containers, particularly those with rectangular cross-sectional configurations, elevations 6 are however preferably provided at all four corners of the inner hollow body 2.

The elevations 6 are preferably equally spaced apart in the longitudinal direction of the assembly, and at each longitudinal position along the length of the hollow member 2 the elevations 6 are arranged in a common plane extending perpendicularly with respect to the longitudinal direction of the member 2. The webs 5 of the outer hollow member 1 are also preferably arranged to lie in a common transverse plane.

Figure 4:
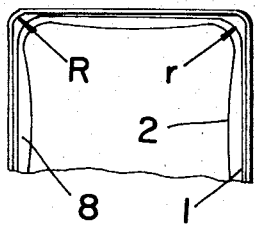
FIG. 4 is a partial sectional view taken through two combined hollow members transversely to the longitudinal direction thereof.

The structure of the rounded corners of the hollow members 1 and 2 is of significance in order to impart to the packing container assembly adequate stability in the overlapping areas particularly when the assembly is in a position with the members 1 and 2 arranged the farthest distance apart. The configuration is significant in order to provide a secure locking engagement and also to permit air to escape from the packing container assembly when the hollow members are pushed together and also to permit air to enter when the assembly members are pulled apart. For this reason, as best seen in FIG. 4, the inner hollow body 2 is formed with corners having an outer radius of curvature r of the corners which is selected to be larger than the inner radius of curvature R of the corners of the outer hollow body 1. That is, the radius of curvature r at the inner hollow body 2 is approximately 2 to 3 mm larger than the corner radius of curvature R at the outer hollow body 1.

The elevations 6 on the inner hollow body 2 are constructed as protuberances which may have a spherical configuration with a circular base, or as sections of a spheroid with an oval base surface.

Figure 3:
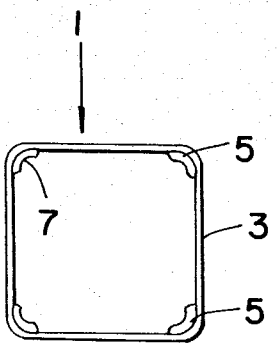
FIG. 3 is a sectional view taken through the outer hollow member transversely to its longitudinal direction with a view of the closed end face.

Advantageously, the webs 5 which connect adjacent walls of the outer hollow member 1 are not constructed with an edge which extends straight between the walls, but are provided in the center of their extensions with a rounded recess 7 in this edge, as shown in FIG. 3.

Figure 5:
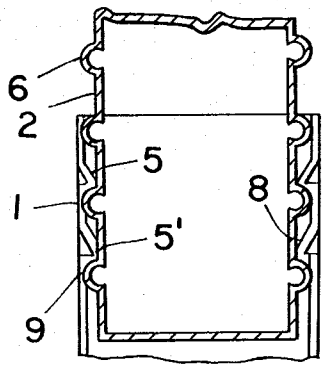
FIG. 5 is a partial longitudinal sectional view taken through the area of an open end of the outer hollow member parallel to its longitudinal axis.

The inwardly projecting webs 5 are preferably provided with a slope 8 which decreases toward the closed end 3 of the hollow member 1 and then changes into a horizontal or approximately horizontal surface 9 which faces the closed end 3 of the hollow body (see FIG. 5).

In a packing container having a larger cross-sectional configuration, its stability in the most extended position can be increased by providing two webs 5 (FIG. 5) in the area of the open end of the hollow member 1. The distance between these webs may correspond in the axial direction of the hollow member to the distance between the elevations 6 on the inner hollow member 2.

The longitudinal walls of the inner hollow member 2 are preferably constructed in such a manner that they have, at least in the area of the open end, a slight curvature 18 which is directed toward the longitudinal axis of the hollow member. This is accomplished by means of appropriate dimensioning of the radius r. This exerts a certain pressure on the elevations 6 and improves the locking interconnection with the webs 5. Also, in this manner, in addition to the air which may enter along the protuberances due to the different radii of the corner curvatures of the inner and outer hollow members into the packing container assembly, an additional air passage is provided. Since the inner walls of the outer hollow member are in close contact over a larger surface at the outer walls of the inner hollow member, without the possibility or provision of some air passage, there would otherwise occur the danger that a vacuum in the container could be developed and the container would then no longer be capable of being opened or it would involve difficulty when it is desired to open the container.

Figure 7:
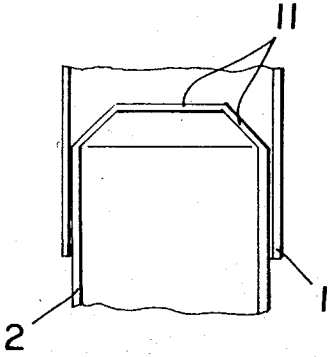
FIG. 7 is a sectional view taken along the line VII—VII of FIG. 6.
Figure 2:
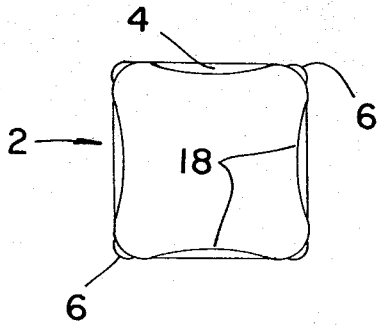
FIG. 2 is a sectional view through the inner hollow member taken transversely to its longitudinal direction with a view of the closed end face.
Figure 6:
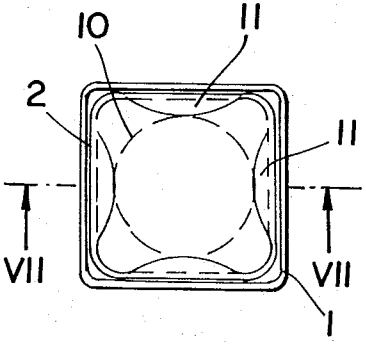
FIG. 6 is a sectional view through the outer hollow member with a view on the open end of the inner hollow member.

To facilitate pushing of the two hollow members together, it is important particularly for automated packing processes that the wall surfaces 11 which enclose the open end of the inner hollow member and are located outside of the first of its elevations or protuberances receive preferably a slight inclination toward the axis of the hollow member. This inclination may, in a special case, be so strong that, as shown in FIGS. 6 and 7, there is ensured not only an easy insertion of the inner member into the outer member, but also fixing of an object 10 having a circular cross-sectional configuration is also made possible. Since the open end of the inner hollow member in a correctly assembled packing container is approximately at the center of its entire length, a cylindrical object 10 may be secured within a packing container having a square cross-sectional configuration. The same, of course, is applicable for an object having an oval cross-sectional configuration within a packing container having a rectangular cross-sectional configuration.

The end face 4 of the inner hollow member 2 is preferably widened beyond its outer wall surfaces in order to form a collar 12 having dimensions which are equal to the outside dimensions of the outer hollow member 1. The collar 12 will then facilitate grasping and pulling of the inner hollow member 2 and therefore offers equalization with respect to greater outside dimensioning of the outer hollow member 1 when stacking horizontal packing containers. This also improves the stability of the packing container when in an upright position.

It may be advantageous to provide in at least one wall of the inner hollow member 2 adjacent to its end face 4 a gripping recess 13 whereby improved gripping of the hollow member 2 may be achieved in order to facilitate longitudinal movement of the member 2 relative to the member 1.

At one of the end faces 3 or 4, a suspension loop may be provided in order to enable hanging of the packing container assembly on sales displays stands or the like.

Figure 8:
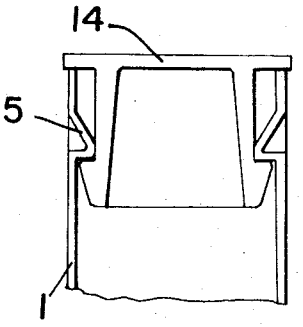
FIG. 8 is a longitudinal sectional view through a further embodiment of the invention whereby the arrangement of FIG. 5 may be modified with a plug as a closure.

FIG. 8 shows a variation wherein the outer hollow member 1 is closed by means of a plug 14 which consists of elastic material and which rests due to a bulge constructed at the free edge of its side walls at the surface 9 of the webs 5.

The configuration described herein is for a square packing container assembly, but it may also be applicable for instance to a hexagonal container wherein the inner hollow member receives elevations at three diametrically opposite corners, with the outer hollow member being provided at each corner with a web.

While specific embodiments of the invention have been shown and described in detail to illustrate the application of the inventive principles, it will be understood that the invention may be embodied otherwise without departing from such principles.

What is claimed is:

1. A packing container assembly particularly for storing elongated objects comprising:

an inner and an outer elongated hollow member each having a polygonal cross-sectional configuration with a closed end and an open end, said open end of said inner hollow member being inserted into said open end of said outer hollow member to place said hollow members in longitudinal sliding engagement relative to each other to form said container assembly;

first interlocking means formed on the outer surface of said inner hollow member;

second interlocking means formed onfhe inner surface of said outer hollow member, said second interlocking means comprising inwardly projecting webs formed in said outer hollow member;

said first and said second interlocking means cooperating to hold said hollow members in fixed engagement with each other;

said first interlocking means comprising a plurality of longitudinally spaced members with each of said members comprising protuberances extending outwardly from said inner hollow member and with said members being located diagonally opposite each other and lying in a common plane extending perpendicularly to the longitudinal direction of said hollow members;

the polygonal cross-sectional configuration of each of said hollow members being formed with interfitting corners, with the corners of said inner hollow member being formed with an outer radius of curvature which is greater than the inner radius of curvature of said corners of said outer hollow member;

each of said inner and outer hollow members being formed as a solid, one-piece member of relatively stiff material.

2. An assembly according to claim 1 wherein said protuberances are equally spaced in the axial direction of said inner hollow member.

3. An assembly according to claim 1 wherein said inwardly projecting webs formed in said outer hollow member have a center area with a rounded recess.

4. An assembly according to claim 3 wherein said inwardly projecting webs are provided with a slope directed toward the closed end of said outer hollow member, said slope changing over into a generally horizontal surface facing the closed end of said outer hollow member.

5. An assembly according to claim 4 wherein said inwardly projecting webs are arranged longitudinally adjacent each other in pairs with the longitudinal distance between said pairs of webs corresponding to the longitudinal spacing between said protuberances on said inner hollow member.

6. An assembly according to claim 1 wherein said inner hollow member is formed with longitudinal walls extending between said corners thereof which are formed at least in the area of said open end of said inner hollow member with a slight curvature which is directed inwardly of said inner hollow member.

7. An assembly according to claim 1 wherein said inner hollow member is formed at said open end thereof with walls extending between said corners, said walls being inclined inwardly of said inner hollow member in an area which lies longitudinally beyond the longitudinally outermost of said longitudinally spaced members.

8. An assembly according to claim 1 wherein said inner hollow member is provided with said protuberances at each of the corners thereof.

9. An assembly according to claim 1 wherein said protuberances are constructed with a generally spherical configuration having an oval base surface.

10. An assembly according to claim 1 wherein said protuberances are constructed with a generally spherical configuration having a circular base surface.

11. An assembly according to claim 1 wherein said closed end of said inner hollow member is formed with an outwardly directed collar having a dimension which corresponds to the dimensions of said outer hollow member.

12. An assembly according to claim 1 wherein said inner and outer hollow members are generally equal in length.

13. An assembly according to claim 9 wherein said oval base surface of said protuberances is formed with a larger oval axis which is directed transversely relative to the longitudinal direction of said inner hollow member.

* * * * *